US007422697B2

(12) United States Patent
Takahashi et al.

(10) Patent No.: US 7,422,697 B2
(45) Date of Patent: Sep. 9, 2008

(54) COMPOSITE SINTERED MAGNETIC MATERIAL, ITS MANUFACTURING METHOD, AND MAGNETIC ELEMENT USING COMPOSITE SINTERED MAGNETIC MATERIAL

(75) Inventors: Takeshi Takahashi, Yawata (JP); Nobuya Matsutani, Katano (JP); Kazuaki Onishi, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 286 days.

(21) Appl. No.: 10/955,883

(22) Filed: Sep. 30, 2004

(65) Prior Publication Data

US 2005/0072955 A1 Apr. 7, 2005

(30) Foreign Application Priority Data

Oct. 3, 2003 (JP) ..... 2003-345399

(51) Int. Cl.
*H01F 1/33* (2006.01)

(52) U.S. Cl. ..... 252/62.55; 252/62.64; 252/62.62; 264/611; 264/667; 264/122; 264/642; 428/928; 428/900; 428/611; 428/548; 428/552

(58) Field of Classification Search ..... 252/62.55, 252/62.64, 62.62; 428/928, 548, 522, 611, 428/900; 264/611, 667, 122, 642
See application file for complete search history.

(56) References Cited

U.S. PATENT DOCUMENTS 3,502,584 A * 3/1970 Denes ..... 252/62.55
5,227,235 A * 7/1993 Moro et al. ..... 428/357
5,238,507 A * 8/1993 Kugimiya et al. ..... 148/307
5,348,800 A 9/1994 Moro et al.
6,726,740 B1 * 4/2004 Draxler et al. ..... 75/246
2004/0161600 A1 * 8/2004 Igarashi et al. ..... 428/328

FOREIGN PATENT DOCUMENTS

| | | | |
|---|---|---|---|
| GB | 805710 | * | 10/1958 |
| GB | 805 710 | | 12/1958 |
| JP | 56-038402 A | | 4/1981 |
| JP | 62-247005 A | | 10/1987 |
| JP | 2003-105480 | | 4/2003 |
| JP | 2003-193174 | | 7/2003 |
| WO | WO 01/45116 | | 6/2001 |
| WO | WO 01/45116 | * | 11/2001 |
| WO | WO 02/081129 | * | 10/2002 |

OTHER PUBLICATIONS

Translation of JP 2003-105480.*
Translation of JP 2003-192174.*
European Search Report dated Mar. 29, 2006, for corresponding European Patent Application EP 04 02 3421.

* cited by examiner

*Primary Examiner*—C. Melissa Koslow
(74) *Attorney, Agent, or Firm*—RatnerPrestia

(57) ABSTRACT

A composite sintered magnetic material comprises a kind of metal powder at least one selected from the group consisting of Fe, Fe—Si type, Fe—Ni type, Fe—Ni—Mo type, and Fe—Si—Al type, and a ferrite layer formed from a kind of ferrite powder at least one selected from the group consisting of Ni—Zn type, Mn—Zn type, and Mg—Zn type, wherein a diffusion layer is formed by sintering between both of these to integrates the both.

12 Claims, 8 Drawing Sheets

FIG. 7

| Sample No. | Metal powder composition (wt%) | Ferrite composition (mol%) | Forming pressure (ton/cm$^2$) |
|---|---|---|---|
| 1 | 96.8Fe-3.2Si | 25.1NiO-26.7ZnO-48.2$Fe_2O_3$ | 8.2 |
| 2 | 95.7Fe-5.3Si | 23.5MnO-25.4ZnO-51.1$Fe_2O_3$ | 12 |
| 3 | 16.9Fe-78.2Ni-4.9Mo | 7.5NiO-24.9ZnO-10.1CuO-48.5$Fe_2O_3$ | 7 |
| 4 | Fe | 25.1NiO-26.7ZnO-48.2$Fe_2O_3$ | 1.2 |
| 5 | 48.9Fe-51.1Ni | 23.3MgO-23.9ZnO-5.0CuO-48.8$Fe_2O_3$ | 9.5 |
| 6 | 96.5Fe-3.5Si | - | 12 |
| 7 | 50.1Fe-49.9Ni | - | 12 |
| 8 | - | 24.9NiO-26.2ZnO-48.9$Fe_2O_3$ | 1 |
| 9 | - | 24.0MnO-25.5ZnO-50.5 $Fe_2O_3$ | 1 |

| Sample No. | Sintering & heat treating temperature (°C) | Diffusion layer | Permeability (50Oe) | Core loss (kW/m$^3$) | Core strength (4kg or over =O) |
|---|---|---|---|---|---|
| 1 | 850 | Partial | 180 | 440 | O |
| 2 | 1100 | Entire | 220 | 250 | O |
| 3 | 870 | Entire | 110 | 480 | O |
| 4 | 800 | Partial | 160 | 390 | O |
| 5 | 900 | Partial | 210 | 405 | O |
| 6 | 800 | - | 64 | 1600 | × |
| 7 | 700 | - | 70 | 690 | × |
| 8 | 1200 | - | 2 | 480 | O |
| 9 | 1250 | - | 3 | 350 | O |

FIG. 8

| Sample No. | Forming pressure (ton/cm$^2$) | Permeability (50Oe) | Core loss (kW/m$^3$) |
|---|---|---|---|
| 10 | 0.1 | 65 | 510 |
| 11 | 0.5 | 80 | 479 |
| 12 | 2 | 105 | 402 |
| 13 | 5 | 180 | 300 |
| 14 | 10 | 210 | 280 |
| 15 | 15 | 170 | 420 |
| 16 | 20 | 89 | 1350 |

FIG. 9

| Sample No. | Sintering atmosphere | Heat treating atmosphere | Permeability (50Oe) | Core loss (kW/m$^3$) |
|---|---|---|---|---|
| 17 | Nitrogen | Nitrogen | 65 | 1310 |
| 18 | Nitrogen | Atmospheric | 190 | 430 |
| 19 | Argon | Atmospheric | 185 | 440 |
| 20 | Atmospheric | Atmospheric | 60 | 1400 |

FIG. 10

| Sample No. | Sintering & heat treating temperature (°C) | λ/d | Current value (A) | Core loss (kW/m$^3$) | Core strength (4kg or over = O) |
|---|---|---|---|---|---|
| 21 | 700 | 5.0E-05 | 3.9 | 269 | × |
| 22 | 800 | 1.0E-04 | 6.1 | 270 | O |
| 23 | 900 | 7.0E-04 | 7 | 290 | O |
| 24 | 1000 | 3.0E-03 | 9.3 | 320 | O |
| 25 | 1300 | 1.0E-01 | 12.4 | 480 | O |
| 26 | 1400 | 4.5E-01 | 13.2 | 890 | O |

FIG. 11

| Sample No. | Metal powder composition (wt%) | Ferrite composition (mol%) | Ferrite addition |
|---|---|---|---|
| 27 | 54.35Fe-45.65Ni | 24.5MgO-25.4ZnO-50.1$Fe_2O_3$ | Ferrite powder/ surface coat |
| 28 | 85.57Fe-9.50Si-4.93Al | 21.0NiO-25.1ZnO-4.9CuO-49.0$Fe_2O_3$ | Ferrite powder/ surface coat |
| 6 | 96.5Fe-3.5Si | - | - |
| 7 | 50.1Fe-49.9Ni | - | - |
| 8 | - | 24.9NiO-26.2ZnO-48.9$Fe_2O_3$ | - |
| 9 | - | 24.0MnO-25.5ZnO-50.5$Fe_2O_3$ | - |

| Sample No. | Forming pressure (ton/$cm^2$) | Sintering & heat treating temperature (°C) | Diffusion layer | Permeability (50Oe) | Core loss (kW/$m^3$) | Core strength (4kg or over = O) |
|---|---|---|---|---|---|---|
| 27 | 0.5 | 900 | Partial | 120 | 450 | O |
| 28 | 5 | 1000 | Entire | 190 | 290 | O |
| 6 | 12 | 800 | - | 64 | 1600 | × |
| 7 | 12 | 700 | - | 70 | 690 | × |
| 8 | 1 | 1200 | - | 2 | 480 | O |
| 9 | 1 | 1250 | - | 3 | 350 | O |

FIG. 12

| Sample No. | Metal powder composition (wt%) | Ferrite composition (mol%) | Ferrite addition |
|---|---|---|---|
| 29 | 96.8Fe-3.2Si | 15.5NiO-24.9ZnO-10.1CuO-49.5$Fe_2O_3$ | Raw/ addition |
| 30 | 95.7Fe-5.3Si | 16.1MgO-24.3ZnO-9.8CuO-49.8$Fe_2O_3$ | Raw/ surface coat |
| 31 | 85.57Fe-9.50Si-4.93Al | 22.3MgO-23.9ZnO-5.0CuO-48.8$Fe_2O_3$ | Raw/ addition |
| 32 | Fe | 23.2MnO-24.8ZnO-52.0$Fe_2O_3$ | Raw/ surface coat |
| 6 | 96.5Fe-3.5Si | - | - |
| 7 | 50.1Fe-49.9Ni | - | - |
| 8 | - | 24.9NiO-26.2ZnO-48.9$Fe_2O_3$ | - |
| 9 | - | 24.0MnO-25.5ZnO-50.5$Fe_2O_3$ | - |

| Sample No | Forming pressure (ton/cm$^2$) | Sintering & heat treating temperature (°C) | Diffusion layer | Permeability (50Oe) | Core loss (kW/m$^3$) | Core strength (4kg or over = O) |
|---|---|---|---|---|---|---|
| 29 | 6.2 | 890 | Entire | 200 | 400 | O |
| 30 | 3 | 920 | Entire | 130 | 420 | O |
| 31 | 4.5 | 950 | Entire | 160 | 395 | O |
| 32 | 2.5 | 1150 | Entire | 205 | 300 | O |
| 6 | 12 | 800 | - | 64 | 1600 | × |
| 7 | 12 | 700 | - | 70 | 690 | × |
| 8 | 1 | 1200 | - | 2 | 480 | O |
| 9 | 1 | 1250 | - | 3 | 350 | O |

COMPOSITE SINTERED MAGNETIC MATERIAL, ITS MANUFACTURING METHOD, AND MAGNETIC ELEMENT USING COMPOSITE SINTERED MAGNETIC MATERIAL

FIELD OF THE INVENTION

The present invention relates to a composite sintered magnetic material used for transformers, choke coils, or magnetic heads, its manufacturing method, and a magnetic element using the composite sintered magnetic material.

BACKGROUND OF THE INVENTION

Recently, there is a trend toward reduction in size of electric and electronic apparatuses, and a magnetic material is also required to be smaller in size and higher in efficiency. As a conventional magnetic material, for example, there are a ferrite magnetic core using ferrite powder for a choke coil used in a high-frequency circuit and a powder magnetic core that is a metal powder compact.

A ferrite magnetic core is low in saturation magnetic flux density, and poor in direct-current superposing characteristic. Accordingly, in a conventional ferrite magnetic core, there is provided a gap of 200 to 300 μm in a direction vertical to the magnetic path in order to assure direct-current superposing characteristic, thereby preventing the value of inductance L from lowering during direct-current superposition. However, such a wide gap causes a humming noise to be generated, and magnetic flux leakage from the gap causes the winding especially at a high-frequency band to be remarkably increased in copper loss.

On the other hand, a powder magnetic core manufactured by compacting soft magnetic metal powder is far higher in saturation magnetic flux density as compared with ferrite magnetic core, which is therefore advantageous for size reduction. Also, unlike a ferrite magnetic core, it can be used without any gap, and is less in copper loss due to humming noise or magnetic flux leakage.

However, it cannot be said that a powder magnetic core is more excellent than a ferrite magnetic core with respect to permeability and core loss. Particularly, in the case of a powder magnetic core used for a choke coil and inductor, the core is greatly increased in temperature because of remarkable core loss, making it difficult to reduce the size. Also, it is necessary for a powder magnetic core to be increased in compacting density in order to improve its magnetic characteristic, and a compacting pressure of 5 tonne/$cm^2$ or over is usually required in the manufacture. For some products, the compacting pressure required in the manufacture is 10 tonne/$cm^2$ or over. Therefore, it is extremely difficult to manufacture small-sized powder magnetic cores used for choke coils which are mounted in products with complicated shapes such as DC-DC converters for computers and required to be low in height. Accordingly, a powder magnetic core is subjected to greater restrictions as a core shape as compared with a ferrite magnetic core, and it is difficult to reduce the size of the product.

The core loss of powder magnetic core usually consists of hysteresis loss and eddy-current loss. Eddy-current loss increases in proportion to the second power of frequency and to the second power of eddy current flowing size. Accordingly, by coating the surface of metal powder with an insulating material, it is possible to suppress the eddy current flowing size so that it is only within metal powder particles instead of the whole core over metal powder particles. In this way, eddy-current loss can be reduced.

On the other hand, regarding the hysteresis loss, since a powder magnetic core is compacted under a high pressure, considerable strain is introduced into the magnetic material, causing the permeability to be lowered and the hysteresis loss to be increased. In order to avoid this, high-temperature heat treatment is executed for releasing such strain as needed after molding. As for high-temperature heat treatment, an insulative binding agent such as water glass and resin is absolutely needed for insulating and binding the metal powder.

As such a powder magnetic core, conventionally, after the surface of metal powder is coated with tetrahydroxylane ($SiOH_4$), the surface of metal powder is coated with $SiO_2$ through heat treatment. After that, powder magnetic core compacted under pressure and heat-treated and metal powder whose surface is coated with tetrahydroxylane ($SiOH_4$) are subjected to heat treatment to coat the surface with $SiO_2$. After that, synthetic resin as a binding agent is mixed, followed by compacting under pressure and heat treatment, and the powder magnetic core obtained assures binding of metal powder. Such a conventional technology is disclosed in Japanese Patent Laid-Open Application S62-247005 (claims 1 and 2).

FIG. 13 is a conceptual sectional view of powder magnetic core 100 in these conventional examples.

In FIG. 13, reference numeral 101 is metal powder, numeral 102 is $SiO_2$ as an insulating material coated on the surface of metal powder 101, and numeral 103 is synthetic resin as a binding agent filled between metal powder 101.

However, in powder magnetic core 100 thus obtained, $SiO_2$ 102 coated on the surface of metal powder 101 is a non-magnetic material, and the existence of a magnetic gap generated between metal powder 101 causes the permeability of powder magnetic core 100 to be lowered. Also, synthetic resin 103 filled between metal powder 101 also turns into a magnetic gap generated between metal powder 101, and in addition, the existence of synthetic resin 103 causes the filling factor of magnetic material in powder magnetic core 100 to be lowered and its permeability to be lowered.

As a core to avoid such lowering of permeability, a powder magnetic core with ferrite being a magnetic material filled between metal powder is conventionally known. Such a powder magnetic core is disclosed in Japanese Patent Laid-Open Application S56-38402.

FIG. 14 is a conceptual sectional view of powder magnetic core 104 in the conventional example. In FIG. 14, reference numeral 105 is metal powder, and numeral 106 is a ferrite layer disposed between metal powder 105.

However, in the case of powder magnetic core 104 in the conventional example wherein ferrite being a magnetic material is filled between metal powder 105, the bonding between metal powder 105 and ferrite layer 106 is not enough to assure sufficient mechanical strength, and there arises a problem of impact resistance. For example, when machining a powder magnetic core, it is finished by a machine at the final stage of machining in order to improve the dimensional accuracy. In that case, there is a problem of cracking in the machining surface or partial peeling and removing.

SUMMARY OF THE INVENTION

A composite sintered magnetic material comprising:

a kind of metal powder at least one selected from the group consisting of Fe, Fe—Si type, Fe—Ni type, Fe—Ni—Mo type, and Fe—Si—Al type, and a kind of ferrite at least one selected from the group consisting of Ni—Zn type, Mn—Zn type, and Mg—Zn type, wherein there is provided a diffusion layer which is formed by sintering between both of these to integrate the both.

A manufacturing method for a composite sintered magnetic material comprising the steps of:

measuring predetermined amounts of a kind of metal powder at least one selected from the group consisting of Fe, Fe—Si type, Fe—Ni type, Fe—Ni—Mo type, and Fe—Si—Al type, and a kind of ferrite at least one selected from the group consisting of Ni—Zn type, Mn—Zn type, and Mg—Zn type;

mixing and dispersing, and compacting under pressure into a predetermined shape, wherein a diffusion layer to be integrated with ferrite is formed around the metal powder by sintering the compact.

A manufacturing method for a composite sintered magnetic material comprising the steps of:

forming a kind of ferrite at least one selected from the group consisting of Ni—Zn type, Mn—Zn type, and Mg—Zn type on the surface of a kind of metal powder at least one selected from the group consisting of Fe, Fe—Si type, Fe—Ni type, Fe—Ni—Mo type, and Fe—Si—Al type, and compacting under pressure into a predetermined shape, wherein a diffusion layer to be integrated with ferrite is formed around the metal powder by sintering the compact.

A magnetic element using the composite sintered magnetic material.

BRIEF DESCRIPTION OF THE DRAWINGS

FIG. 7 is a table showing the characteristics of composite sintered magnetic material in the embodiment 1.

FIG. 8 is a table showing the relations of compacting pressure, permeability, and core loss in a pressure forming process.

FIG. 9 is a table showing the relations of compacting pressure, permeability, and core loss in a pressure forming process.

FIG. 10 is a table showing the relations of magnetic characteristics and mechanical strength of λ/d and composite sintered magnetic material.

FIG. 11 is a table showing the characteristics of composite sintered magnetic material obtained by the manufacturing method of the embodiment 2 of the present invention.

FIG. 12 is a table showing the characteristics of composite sintered magnetic material 11 obtained by the manufacturing method of the embodiment 3 of the present invention.

DETAILED DESCRIPTION OF THE EXEMPLARY EMBODIMENTS

The present invention relates to a composite sintered magnetic material which may improve the low permeability of a conventional powder magnetic core. This may address low mechanical strength of powder magnetic core because of weak bonding between the metal powder and the ferrite layers.

An exemplary embodiment of the present invention includes a kind of metal powder at least one selected from the group consisting of Fe, Fe—Si type, Fe—Ni type, Fe—Ni—Mo type, and Fe—Si—Al type, and a kind of ferrite at least one selected from the group consisting of Ni—Zn type, Mn—Zn type, and Mg—Zn type, wherein there is provided a diffusion layer which is formed by sintering between metal powder and ferrite and serves to integrate the both.

Thus, it may be possible to solve problems such as low direct-current superposing characteristic for low saturation magnetic flux density that is a defect of ferrite, increase of eddy-current loss at high frequency that is a defect of powder magnetic core manufactured by compacting soft magnetic metal powder, and permeability lowering due to magnetic gap in a powder magnetic core with insulating material coated on the surface of metal powder or a powder magnetic core with a binding agent such as resin filled between metal powder. Also, it may be possible to realize excellent soft magnetic characteristic, and to provide a composite sintered magnetic material having excellent mechanical strength.

Embodiment 1

Figure 1:
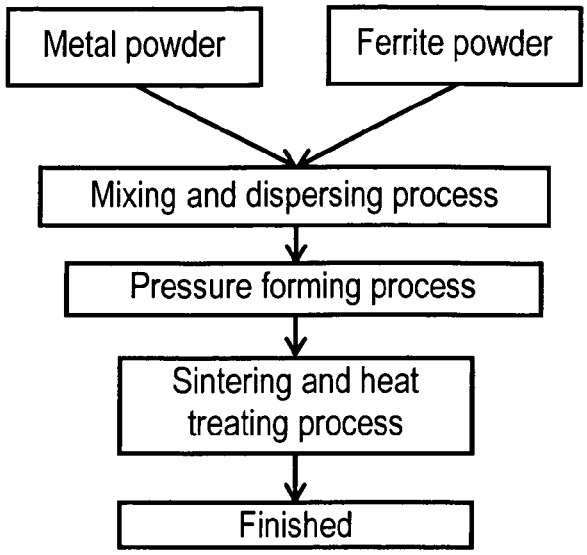
FIG. 1 is a block diagram of a manufacturing method for composite sintered magnetic material in the embodiment 1 of the present invention.

In the embodiment 1, as shown in the block diagram of FIG. 1, ferrite powder of 0.6 μm in average grain size is added by 15 wt % to metal powder of 8 μm in average grain size, and both are mixed and dispersed. After that, pressure forming, sintering, and heat treatment are performed, thereby, manufacturing a composite sintered magnetic material having a shape of about 15 mm in outer dimension, 10 mm in bore diameter, and 3 mm in height.

FIG. 7 shows the characteristics of a composite sintered magnetic material in the embodiment 1. Samples No. 6, 7 are powder magnetic cores using metal powder, and samples No. 8, 9 are ferrite magnetic cores. Samples No. 6 to 9 are the examples for comparison with the composite sintered magnetic material in the embodiment 1. The compositions of metal powder and ferrite powder used in the embodiment 1 are as mentioned in FIG. 7.

Figure 2:
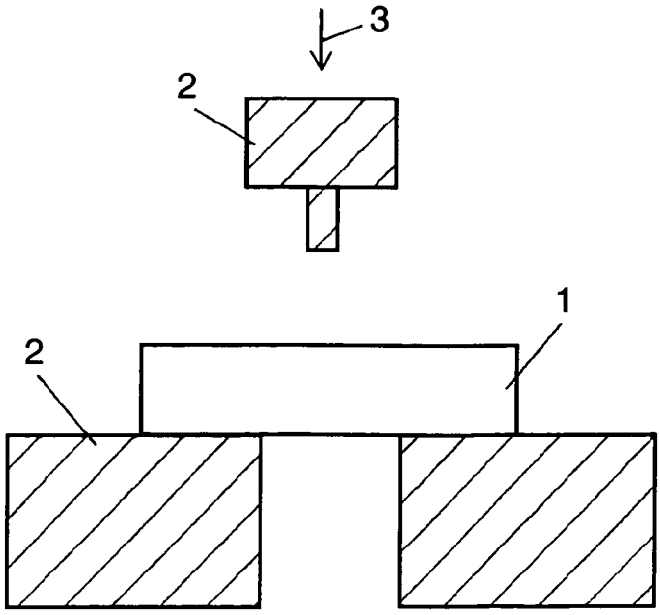
FIG. 2 is a structural diagram showing a tensile test method in the embodiment 1 of the present invention.

In FIG. 7, permeability was measured at frequency 100 kHz by using an LCR meter, and core loss was measured at measuring frequency 100 kHz and measuring magnetic flux density 0.1T by using an AC. B-H curve measuring instrument. Also, as for core strength, the strength of sample was measured by the test method shown in FIG. 2, and it was evaluated to be "○" when the load capacity is 4 kg or over. In FIG. 2, sample 1 used is about 15 mm square and 0.8 mm thick. Reference numeral 2 is a jig, and jigs 2 installed at the bottom of FIG. 2 are 7 mm spaced apart from each other. In FIG. 2, jig 2 positioned there above is pressed at a speed of 20 mm/min. in the direction of arrow 3 of FIG. 2, thereby measuring the strength of the sample.

Of the samples mentioned in FIG. 7, samples No. 1, 3, 4, 5 using Ni type and Mg type as ferrite powder were sintered for 1 to 2 hours at the temperatures mentioned in FIG. 7 in a nitrogen atmosphere after compacting under the conditions mentioned in FIG. 7, followed by heat treatment for 1 to 2 hours at the temperatures in the atmospheric air. On the other hand, sample No. 2 using Mn type as ferrite powder was sintered for 1 to 2 hours at the temperature mentioned in FIG. 7 in a nitrogenous atmosphere after compacting under the conditions mentioned in FIG. 7, followed by heat treatment for 1 to 2 hours at the temperatures in a 2%-oxygen atmosphere. Cooling was performed in a nitrogen atmosphere.

Samples No. 6, 7 used as comparative examples in FIG. 7 were sintered in nitrogen after adding 1 wt % of Si resin to metal powder and compacting under the conditions mentioned in FIG. 7. Samples No. 8, 9 are ferrite magnetic cores. Sample No. 8 was sintered for 1 to 2 hours at the temperature mentioned in FIG. 7 in the atmospheric air after forming under the conditions mentioned in FIG. 7 by using ferrite powder of Ni type. On the other hand, sample No. 9 using ferrite powder of Mn type was subjected to heat treatment for 1 to 2 hours at the temperature in a 2%-oxygen atmosphere after compacting under the conditions mentioned in FIG. 7. Cooling was performed in a nitrogen atmosphere.

Figure 3:
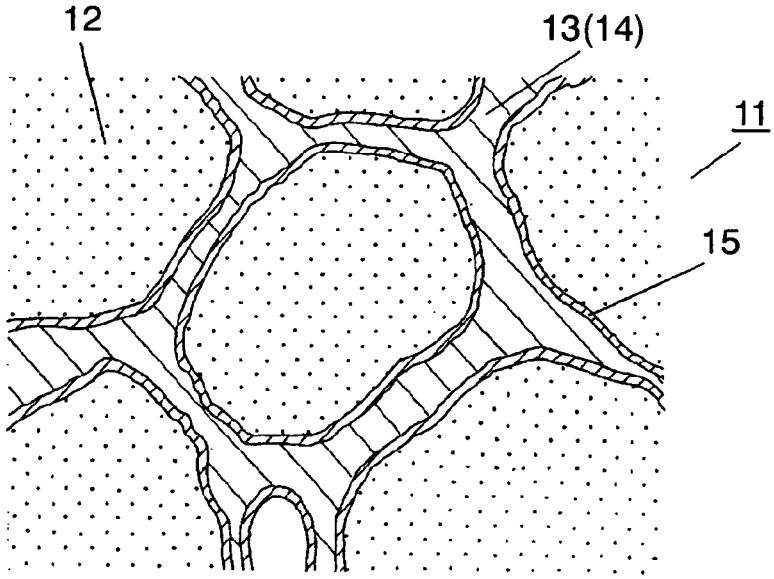
FIG. 3 is a conceptual sectional view of a composite sintered magnetic material obtained by the manufacturing method of the embodiment 1 of the present invention.

FIG. 3 is a schematic sectional view of a composite sintered magnetic material obtained by the manufacturing method in the embodiment 1 of the present invention. In FIG. 3, reference numeral 11 is a composite sintered magnetic material, numeral 12 is metal powder, and numeral 13 is a ferrite layer formed by ferrite powder 14 between metal powder 12. Reference numeral 15 is a diffusion layer formed around metal powder 12 by sintering and bonded so as to integrate metal powder 12 and ferrite layer 13.

Figure 4:
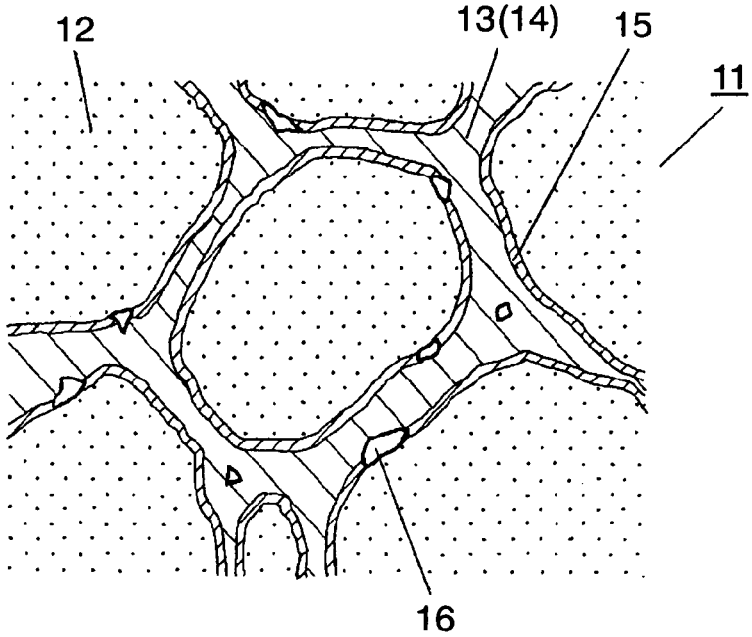
FIG. 4 is a conceptual sectional view of a composite sintered magnetic material obtained by the manufacturing method of the embodiment 1 of the present invention.

In ferrite layer 13, for example, depending upon mixing and dispersing conditions, the state of filling factor of ferrite powder 14 between metal powder 12 after pressure forming, and the conditions such as sintering temperature and time in the sintering process, as shown in FIG. 4, pore 16 is generated in ferrite layer 13 and diffusion layer 15. In FIG. 7, when there is no pore 16, the indication for diffusion layer 15 is "Entire".

As shown in FIG. 7, all of samples No. 1 to 5 of powder magnetic cores obtained by the manufacturing method in the embodiment 1 were able to assure high permeability exceeding that of conventional composite magnetic material (sample No. 6, 7) while assuring low core loss equivalent to that of ferrite core (sample No. 8, 9). Further, it was able to assure core strength higher than that of conventional composite sintered magnetic material (sample No. 6, 7).

In the embodiment 1 of the present invention, examples using Fe, Fe—Si type, Fe—Ni type, Fe—Ni—Mo type are mentioned as metal powder 12. Besides these, it is also possible to use metal powder 12 of Fe—Si—Al type. Also, the superposing rates of Fe, Si, Ni, Mo, and Al in metal powder 12 can be freely decided.

Also, in the embodiment 1 of the present invention, metal powder 12 of 18 μm in average grain size is used, but it is not limited to this size. However, the grain size of metal powder 12 is preferable to be 1 to 100 μm. If metal powder 12 is smaller than 1 μm, aggregation of metal powder will be enhanced, and in the mixing and dispersing process after adding ferrite powder 14, some of metal powder 12 will remain in a state of contacting with each other. On the other hand, if metal powder 12 is larger than 100 μm, it will cause eddy-current loss to be increased. Metal powder 12 is more preferable to range from 3 to 60 μm.

Further, in the embodiment 1 of the present invention, Ni—Zn type, Mn—Zn type, Mg—Zn type, or the one with Cu added to these are used as ferrite powder 14. Besides these, it is also possible to use the one with at least one of Li, Na, Mg, Ca, Al, Sc, Ti, V, Mn, Co, Ni, Cu, Mo, Rh, W, Cd, Ga, Ge, Sn, Sb added to these.

Also, in the embodiment 1 of the present invention, ferrite powder 14 of 0.6 μm in average grain size is used, but it is not limited to this size. However, the grain size of ferrite powder 14 is preferable to be 0.02 to 2 μm. If ferrite powder 14 is smaller than 0.02 μm, it will worsen the yield and increase the cost in the manufacturing process. On the other hand, if ferrite powder 14 is larger than 2 μm, it will become difficult to finely coat the surface of metal powder 12, and some of metal powder 12 will remain in a state of contacting with each other.

Further, in the embodiment 1 of the present invention, the one with 15 wt % of ferrite powder 14 added to metal powder 12 is used, but it is possible to freely adjust the mixing ratio, adding ferrite powder 14 by 2 wt % or over. In case ferrite powder 14 is less than 2 wt %, metal powder 12 comes in contact with each other in the pressure forming process, and it becomes difficult to assure the insulation of composite sintered magnetic material 11. On the other hand, in order to realize excellent direct-current superposing characteristic, it is necessary to decide the mixing ratio of metal powder 12 and ferrite powder 14 so that the saturated magnetic flux density is at least 1T or more preferable to be 1.5T or over, and it is necessary to keep the mixing ratio of ferrite powder 14 within a range such that the saturated magnetic flux density is not lower than the above value.

In the embodiment 1 of the present invention, there is no particular mention about the method of mixing and dispersing in the mixing and dispersing process, but it is not limited to any particular method of mixing and dispersing, and for example, it is possible to perform mixing and dispersing by using various types of ball mills such as a rotary ball mill and a planetary ball mill.

Also, in the embodiment 1 of the present invention, there is no particular mention about the method of pressure forming in the pressure forming process, but it is not limit to any particular method of pressure forming. It is possible to use a proper pressure as the forming pressure in the pressure forming process, but the pressure used is preferable to be 0.5 tonne/cm$^2$ to 15 tonne/cm$^2$. If the pressure is lower than 0.5 tonne/cm$^2$, the compact density obtained is very low, and numerous pores will remain in composite sintered magnetic material 11 even after the later sintering process, causing the sintered body to be lowered in density, and as a result, it is difficult to improve the magnetic characteristic. Also, if the pressure is higher than 15 tonne/cm$^2$, metal powder 12 comes in contact with each other, causing the eddy-current loss to be increased. In addition, the die assembly is large-sized for assuring the metal assembly strength in the pressure forming process, and the press machine is large-sized for assuring the forming pressure. Further, the large-sized die assembly and press machine will result in lowering of the productivity and cost increase of the magnetic material.

FIG. 8 shows the relations of forming pressure, permeability and core loss in the pressure forming process.

In FIG. 8, metal powder 12 of 15 μm in average grain size which is composed of 9.50 wt % of Si and 93 wt % of Al as against 85.57 wt % of Fe, and ferrite powder 14 of 0.5 μm in average grain size which is composed of 21.0 mol % of NiO, 25.1 mol % of ZnO, 4.9 mol % of CuO, and 49.0 mol % of $Fe_2O_3$ are measured so that ferrite powder 14 is 10 wt %, and both are mixed and dispersed, then compacted under the pressures mentioned in FIG. 8, followed by sintering for 1 to 2 hours in a nitrogen atmosphere at 850° C. After that, the evaluation was made by using samples 10 to 16 heat-treated for 1 to 2 hours in the atmospheric air.

As shown in FIG. 8, when the compacting pressure is lower than 0.5 tonne/$cm^2$, composite sintered magnetic material 11 manufactured is lower in permeability and greater in core loss. Also, when the compacting pressure is higher than 15 tonne/$cm^2$, the core loss is very remarkable. In FIGS. 7, 8, 11, and 12, the term "ton" refers to a "metric ton" or tonne.

Further, in the embodiment 1 of the present invention, there is no particular mention about the method of sintering in the sintering process, but it is not limited to any particular method of sintering, and it is possible to employ an electric oven or the like. Also, it is possible to set the sintering temperature in the sintering process at a proper temperature, it is preferable to set the temperature in a range of 800° C. to 1300° C. If the sintering temperature is lower than 800° C., the density obtained by sintering will be insufficient, and if the sintering temperature is higher than 1300° C., the composition will be affected due to volatilization of component elements or it will become difficult to obtain excellent magnetic characteristic due to grain enlargement.

When partial pressure control of oxygen is needed during sintering operation, it is possible to use an electric oven capable of atmospheric control. In that case, it is possible to follow the procedure such that a compact formed of metal powder 12 and ferrite powder 13 compacted under pressure is first sintered in a non-oxidation atmosphere, followed by heat treatment in a balanced oxygen partial pressure atmosphere in which ferrite layer 13 becomes at least a spinel phase of 90% or over. Thus, it is possible to suppress the lowering of magnetic characteristic due to oxidation of metal powder 12, and also, to reduce by sintering in a non-oxygen atmosphere and to re-oxidize ferrite layer 13 lowered in characteristic, thereby restoring the characteristic. Thus, it is possible to provide a composite sintered magnetic material excellent in soft magnetic characteristic and mechanical strength.

FIG. 9 shows the relations of sintering atmosphere, permeability, and core loss in the heat treatment process.

In FIG. 9, metal powder 12 of 11 μm in average grain size which is composed of 4.5 wt % of Si as against 95.5 wt % of Fe, and ferrite powder 14 of 0.4 μm in average grain size which is composed of 23.5 mol % of NiO, 24.3 mol % of ZnO, 4.1 mol % of CuO, and 48.1 mol % of $Fe_2O_3$ are measured so that ferrite powder 14 is 13 wt %, and both are mixed and dispersed, then compacted under forming pressure tonne/$cm^2$, followed by sintering at 890° C. for 1 to 2 hours in the atmosphere mentioned in FIG. 9. After that, the evaluation was made by using samples 17 to 20 heat-treated at 890° C. for 1 to 2 hours in the atmosphere mentioned in FIG. 9.

As shown in FIG. 9, it is clear that samples No. 18, 19 sintered in a non-oxygen atmosphere and heat-treated in a balanced oxygen partial pressure atmosphere are higher in permeability and lower in core loss as compared with samples No. 17, 20 mentioned as comparative examples in FIG. 9.

Also, in the embodiment 1 of the present invention, when the thickness of diffusion layer 15 formed in the sintering process is λ, and the grain size of metal powder 12 is d, then the relationship is preferable to be $\lambda/d=1\times10^{-4}\leqq\lambda/d\leqq1\times10^{-1}$. In case λ/d is smaller than $1\times10^{-4}$, then diffusion layer 15 will be thinner, and composite sintered magnetic material 11 will be lower in mechanical strength. On the other hand, in case λ/d is larger than $1\times10^{-1}$, then diffusion layer 15 will be thicker, and composite sintered magnetic material 11 will be lower in magnetic strength.

Further, it is possible to control the direct-current superposing characteristic of composite sintered magnetic material 11 in the embodiment 1 of the present invention by adjusting the thickness of diffusion layer 15. Since the permeability of diffusion layer 15 is different from the permeability of metal powder 12 or ferrite layer 13, it is possible to control the permeability of composite sintered magnetic material 11 by controlling the thickness of diffusion layer 15. As a result, it becomes possible to control the direct-current superposing characteristic of composite sintered magnetic material 11. In this case, control of diffusion layer 15 can be made by adjusting the sintering temperature and the sintering time in the sintering process in the embodiment 1 of the present invention. That is, diffusion layer 15 is thicker when the sintering temperature is higher or the sintering time is longer, and it is thinner when the sintering temperature is lower or the sintering time is shorter.

FIG. 10 shows the relations of λ/d that shows the relationship between thickness λ of diffusion layer 15 and grain size d of metal powder 12, and the magnetic characteristic and mechanical strength of composite sintered magnetic material 11.

In FIG. 10, metal powder 12 of 20 μm in average grain size which is composed of 47.9 wt % of Ni as against 52.1 wt % of Fe, and ferrite powder 14 of 1 μm in average grain size which is composed of 23.5 mol % of NiO, 25.0 mol % of ZnO, and 51.5 mol % of $Fe_2O_3$ are measured so that ferrite powder 14 is 20 wt %, which are mixed and dispersed, then compacted under forming pressure 7 tonne/$cm^2$, followed by sintering for 1 to 2 hours in a nitrogen atmosphere at the temperature mentioned in FIG. 10. After that, the evaluation was made by using samples 21 to 26 heat-treated for 1 to 2 hours at the temperature mentioned in FIG. 10 in a 2% oxygen atmosphere and cooled in a nitrogen atmosphere. The sample is a troidal core in shape of 15mm in outer dimension, 10 m in bore diameter, and 3 mm in height.

In FIG. 10, L value was measured with 20T, and the evaluation was made in accordance with the current value with L value decreased by 20%. In FIG. 10, the greater the current value (A), the better the direct-current superposing characteristic.

As shown in FIG. 10, when the sintering and heat treating temperatures are lower than 800° C., ratio λ/d of thickness λ of diffusion layer 15 to thickness d of metal powder 12 is smaller than $1\times10^{-4}$, and composite sintered magnetic material 11 becomes lower in mechanical strength. On the other hand, when the sintering and heat treating temperatures exceed 1300° C., λ/d is larger than $1\times10^{-1}$, and core loss becomes greater.

Thus, it is possible to control the direct-current superposing characteristic in composite sintered magnetic material 11 by adjusting the thickness of diffusion layer 15 through adjustment of the sintering temperature. Accordingly, it is possible to provide composite sintered magnetic material 11 excellent in mechanical strength while meeting the requirements as a transformer, choke coil, etc. Such control can be performed not only by adjusting the sintering temperature but also by adjusting the sintering time.

In the embodiment 1 of the present invention, metal powder 12 and ferrite powder 14 are formed under pressure after mixing and dispersing, followed by sintering, but it is also possible to simultaneously perform the pressure forming process and the sintering process by using HIP or SPS.

Embodiment 2

In the embodiment 2 of the present invention, the surface of metal powder 12 is coated with ferrite layer 13, for example, by a non-electrolytic plating, coprecipitation, mechanofusion, evaporation, sputtering process, and the like. After that, metal powder 12 coated with ferrite layer 13 is compacted under pressure and the compact obtained is sintered, thereby forming diffusion layer 15 between metal powder 12 and ferrite layer 13. In this way, it is possible to omit the mixing and dispersing process from the manufacturing method for composite sintered magnetic material 11 in the embodiment 1. Also, by using the method shown in the embodiment 2 of the present invention, it is possible to assure the existence of ferrite layer 13 between metal powder 12. As a result, it becomes possible to realize excellent high-frequency characteristic while assuring the insulation in composite sintered magnetic material 11.

Figure 5:
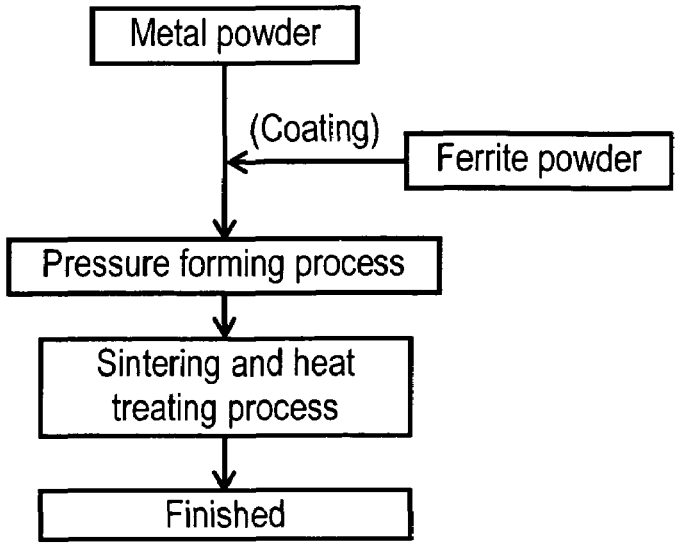
FIG. 5 is a block diagram of the manufacturing method for composite sintered magnetic material in the embodiment 2 of the present invention.

FIG. 5 shows a block diagram of the manufacturing method for composite sintered magnetic material in the embodiment 2 of the present invention.

In this case, it is also possible to coat some of a predetermined amount of ferrite powder 14 to be mixed with metal powder 12 over the surface of metal powder 12 according to the above mentioned coating method, followed by mixing the rest of the predetermined amount of ferrite powder 14. In this way, it becomes possible to more precisely obtain composite sintered magnetic material 11 with ferrite layer 13 existing between metal powder 12. In this case, the productivity is more excellent as compared with the case of forming ferrite layer 13 as intended only by the above-mentioned coating method, and it is also possible to achieve the purpose of cost reduction.

FIG. 11 shows the characteristic of composite sintered magnetic material 11 obtained by the manufacturing method in the embodiment 2 of the present invention. Sample No. 27 mentioned in FIG. 11 was subjected to pressure forming, sintering and heat treatment after coating the surface of metal powder 12 of 19 μm in grain size having the composition of FIG. 11 with ferrite layer 13 of 1.6 μm in thickness having the composition of FIG. 11 through non-electrolytic plating process. The ferrite content of sample No. 27 calculated by saturation magnetization measurement was about 15 wt %. Also, sample No. 28 mentioned in FIG. 11 was subjected to mixing and dispersing, pressure forming, sintering and heat treatment, further adding 10.5 parts by weight of ferrite powder 14 having the composition mentioned in FIG. 11 to 100 parts by weight of metal powder, after coating the surface of metal powder 12 of 19 μm in grain size having the composition of FIG. 11 with ferrite layer 13 of 0.5 μm in thickness having the composition of FIG. 11 through sputtering process. The ferrite content of sample No. 28 calculated by saturation magnetization measurement was about 14 wt %.

The conditions such as those in the mixing and dispersing process, pressure forming process, sintering and heat treatment process are same as in the embodiment 1, and the description is omitted.

As shown in FIG. 11, all the samples No. 27 to 28 of composite sintered magnetic material obtained by the manufacturing method in the embodiment 2 were able to assure high permeability exceeding the conventional composite sintered magnetic material (samples No. 6, 7) while assuring a low core loss equivalent to that of ferrite core (samples No. 8, 9). Further, the core strength obtained was higher than that of conventional composite magnetic material (samples No. 6, 7).

The compositions of metal powder 12 and ferrite powder 14, and the mixing ratio of metal powder 12 to ferrite powder 14 are same as in the embodiment 1.

Also, in the embodiment 2, there is no limitations on the means used in the mixing and dispersing process, pressure forming process, and sintering process, the same as in the embodiment 1 of the present invention. Also, as for the pressure in the pressure forming process, the sintering temperature and sintering time in the sintering process, it is possible to execute the operation under various conditions the same as in the embodiment 1 of the present invention.

Further, it is possible to adjust the thickness of diffusion layer 15 the same as in the embodiment 1 of the present invention.

Embodiment 3

In the embodiment 3 of the present invention, raw ferrite is used instead of ferrite powder 14. It is possible to use NiO, $Fe_2O_3$, ZnO, CuO, MgO, and $MnCo_3$ as raw ferrite. In this case, predetermined amounts of metal powder 12 and raw ferrite are measured, then mixed and dispersed, followed by compacting under pressure, and the compact is sintered to change the raw ferrite into ferrite, and diffusion layer 15 can be formed between metal powder 12 and ferrite layer 13.

Besides the above method, in the manufacturing method shown in the embodiment 2, it is also possible to form diffusion layer 15 between metal powder 12 and ferrite layer 13 by coating the surface of metal powder with raw ferrite instead of ferrite powder 14, for example, by non-electrolytic plating, coprecipitation, mechanofusion, evaporation, sputtering process and the like, followed by pressure forming metal powder 12 coated with the raw ferrite and sintering the compact obtained.

Further, it is possible to coat some of the predetermined amount of raw ferrite to be mixed with metal powder 12 over the surface of metal powder 12 by the non-electrolytic plating or the like, which is followed by mixing the rest of the predetermined amount of raw ferrite.

In this way, using raw ferrite instead of ferrite powder 14 as a ferrite material, it is possible to omit the manufacturing process for ferrite powder 14 and to lower the cost.

FIG. 12 shows the characteristic of composite sintered magnetic material 11 obtained by the manufacturing method in the embodiment 3 of the present invention. Samples No. 29, 31 mentioned in FIG. 12 were subjected to mixing and dispersin, pressure forming, sintering and heat treatment after measuring metal powder 12 of 21 μm in grain size having the composition of FIG. 12 and ferrite powder 14 of 0.02 μm to 2 μm in grain size having the composition of FIG. 12 so that ferrite powder 14 is about 15 wt %. Sample No. 30, 32 mentioned in FIG. 12 were subjected to pressure forming, sintering and heat treatment after coating the surface of metal powder 12 of 21 μm in grain size having the composition of FIG. 12 with ferrite layer 13 having the composition of FIG. 12 through mechanofusion. The conditions such as those in the mixing and dispersing process, pressure forming process, sintering and heat treatment process for the manufacture of composite sintered magnetic material 11, and the compositions of metal powder and ferrite powder are same as in the embodiment 1, and the description is omitted.

As shown in FIG. 12, all the samples No. 29 to 32 of composite sintered magnetic material obtained by the manufacturing method in the embodiment 3 were able to assure high permeability exceeding the conventional composite sintered magnetic material (samples No. 6, 7) while assuring a low core loss equivalent to that of ferrite core (samples No. 8, 9). Further, the core strength obtained was higher than that of conventional composite magnetic material (samples No. 6, 7).

The compositions of metal powder 12 and ferrite powder 14, and the mixing ratio of metal powder 12 to ferrite powder 14 are same as in the embodiment 1.

Also, in the embodiment 3, there is no limitations on the means used in the mixing and dispersing process, pressure forming process, and sintering process, the same as in the embodiment 1 of the present invention. Also, as for the pressure in the pressure forming process, the sintering temperature and sintering time in the sintering process, it is possible to execute the operation under various conditions the same as in the embodiment 1 of the present invention.

Further, it is possible to adjust the thickness of diffusion layer 15 the same as in the embodiment 1 of the present invention.

Embodiment 4

Figure 6:
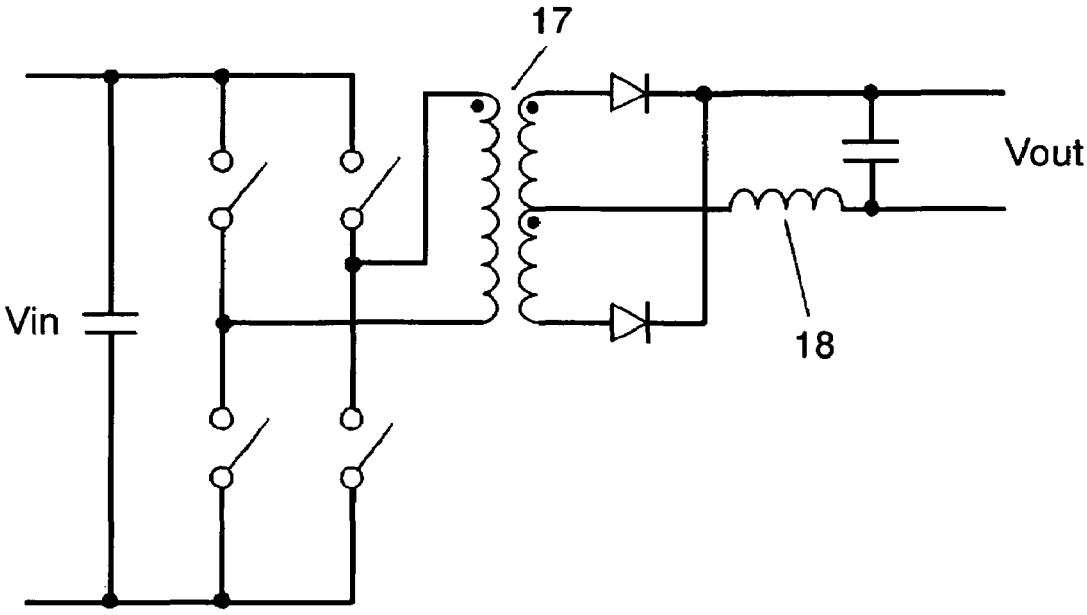
FIG. 6 is a power source circuit diagram in the embodiment 4 of the present invention.
Figure 13:
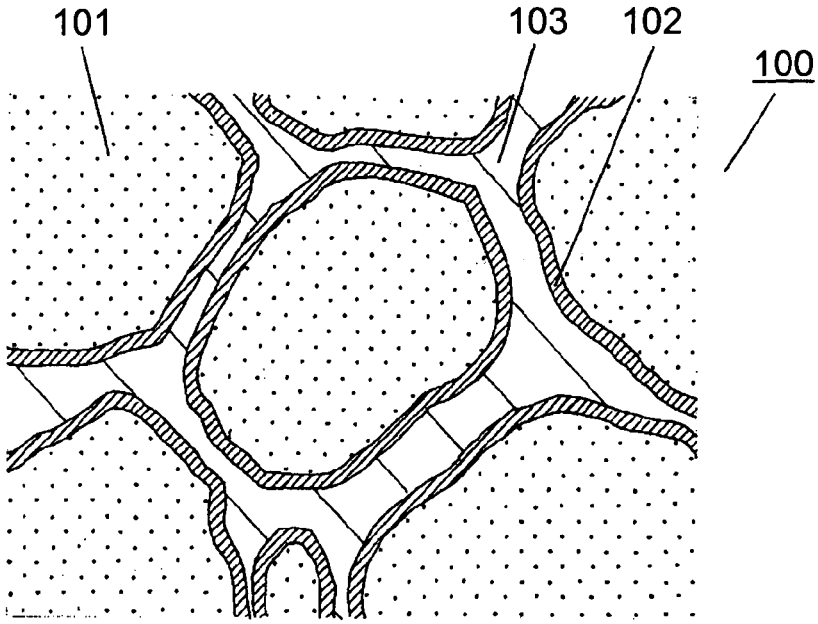
FIG. 13 PRIOR ART
FIG. 13 is a conceptual sectional view of a powder magnetic core in a conventional, i.e., prior art, example.
Figure 14:
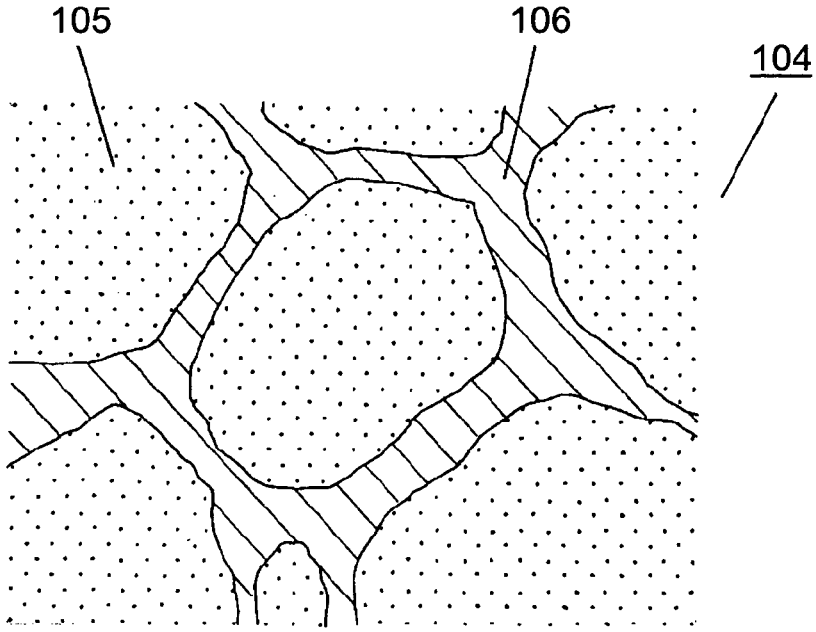
FIG. 14 PRIOR ART
FIG. 14 is a conceptual sectional view of a powder magnetic core in a conventional, i.e., prior art, example.

FIG. 6 is a power source circuit diagram in such case that transformer 17 and secondary smoothing choke coil 18 are configured by using a core formed from ferrite or composite sintered magnetic material. The power source used here is a full-bridge circuit, and the capacity of this power source is 1 kW, and transformer 17 and choke coil 18 are respectively driven at 100 kHz and 200 kHz frequencies.

The power supply efficiency was evaluated by the power source circuit mentioned in FIG. 6.

As a conventional transformer, a core of shape of E31 is used, and as a choke coil, a core of shape of E35 is used. On the other hand, as a transformer in the present invention, a core of shape of E31 made by composite sintered magnetic material 11 in the embodiments 1 to 3 of the present invention is used, and as a choke coil, a core of shape of E27 made by composite sintered magnetic material 11 in the embodiments 1 to 3 of the present invention is used.

As a result, the power supply efficiency of the conventional power source circuit using transformer 17 and choke coil 18 was 88%, while in the case of the power source circuit using transformer 17 and choke coil 18 based on a core made by composite sintered magnetic material 11 of the present invention, the power supply efficiency obtained was 90% or over of the target.

Thus, a power supply device using a core made by composite sintered magnetic material 11 of the present invention is able to meet the requirements for being smaller in size, thinner, lighter in weight, and higher in efficiency. Accordingly, for example, it is possible to reduce the weight of a vehicle mounted with the power supply device, and in the case of a communication base station, it is possible to save the space and realize higher efficiency by using the power supply device reduced in size.

Also, composite sintered magnetic material 11 made by the manufacturing method mentioned in the embodiments 1 to 3 of the present invention can be used for magnetic elements such as inductor, detection coil, thin-film coil and the like.

As described above, the composite sintered magnetic material of the present invention comprises a kind of metal powder at least one selected from the group consisting of Fe, Fe—Si type, Fe—Ni type, Fe—Ni—Mo type, and Fe—Si—Al type, and a kind of ferrite at least one selected from the group consisting of Ni—Zn type, Mn—Zn type, and Mg—Zn type, wherein there is provided a diffusion layer which is formed by sintering between metal powder and ferrite and serves to integrate the both.

Thus, it is possible to solve all problems such as low direct-current superposing characteristic for low saturation magnetic flux density that is a defect of ferrite, increase of eddy-current loss at high frequency that is a defect of powder magnetic core manufactured by compacting soft magnetic metal powder, and permeability lowering due to magnetic gap in a powder magnetic core with insulating material coated on the surface of metal powder or a powder magnetic core with a binding agent such as resin filled between metal powder. Also, it is possible to realize excellent soft magnetic characteristic, and to provide a composite sintered magnetic material having excellent mechanical strength.

The present invention relates to a composite sintered magnetic material, its manufacturing method, and a magnetic element using the composite sintered magnetic material. Particularly, it is useful with respect to a composite sintered magnetic material used for a transformer core, choke coil or magnetic head and the like, its manufacturing method, and a magnetic element using the composite sintered magnetic material.

What is claimed is:

1. A manufacturing method for a composite sintered magnetic material, the method comprising the steps of:

measuring predetermined amounts of a metal powder selected from the group consisting of Fe, Fe—Si type, Fe—Ni type, Fe—Ni—Mo type, and Fe—Si—Al type, and at least one ferrite selected from the group consisting of Ni—Zn type, Mn—Zn type, and Mg—Zn type;

mixing and dispersing the metal powder and the ferrite to form a mixture; and compacting the mixture under pressure into a compact of predetermined shape, sintering the compact in a non-oxidative atmosphere, and forming a diffusion layer around the metal powder, in which the diffusion layer bonds the metal powder and the ferrite, and heat treating the sintered compact in an oxygen containing atmosphere, in which the ferrite becomes at least 90% or more spinel phase;

wherein the oxygen containing atmosphere is from 2% oxygen to 20% oxygen.

2. The manufacturing method for a composite sintered magnetic material of claim 1, wherein sintering is carried out at a temperature ranging from 800° C. to 1300° C.

3. The manufacturing method for a composite sintered magnetic material of claim 1, wherein the oxygen containing atmosphere is a balanced oxygen partial pressure atmosphere.

4. The manufacturing method for a composite sintered magnetic material of claim 1, wherein heat treating is carried out at a temperature ranging from 800° C. to 1300° C.

5. The manufacturing method for a composite sintered magnetic material of claim 1, wherein the non-oxidative atmosphere is $N_2$ or Ar.

6. The manufacturing method for a composite sintered magnetic material of claim 1, wherein the pressure is 0.5 tonne/cm$^2$ to 15 tonne/cm$^2$.

7. A manufacturing method for a composite sintered magnetic material, the method comprising the steps of:

forming a ferrite selected from the group consisting of Ni—Zn type, Mn—Zn type, and Mg—Zn type on the surface of metal powder, the metal powder selected from the group consisting of Fe, Fe—Si type, Fe—Ni type, Fe—Ni—Mo type, and Fe—Si—Al type; and compacting the metal powder and ferrite under pressure into a compact of predetermined shape, sintering the compact in a non-oxidative atmosphere, and forming a diffusion layer around the metal powder, in which the diffusion layer bonds the metal powder and the ferrite, and heat treating the sintered compact in an oxygen containing atmosphere, in which the ferrite becomes at least 90% or more spinel phase;

wherein the oxygen containing atmosphere is from 2% oxygen to 20% oxygen.

8. The manufacturing method for a composite sintered magnetic material of claim 7, wherein sintering is carried out at a temperature ranging from 800° C. to 1300° C.

9. The manufacturing method for a composite sintered magnetic material of claim 7, wherein oxygen containing atmosphere is a balanced oxygen partial pressure atmosphere.

10. The manufacturing method for a composite sintered magnetic material of claim 7, wherein heat treating is carried out at a temperature ranging from 800° C. to 1300° C.

11. The manufacturing method for a composite sintered magnetic material of claim 7, wherein the non-oxidative atmosphere is $N_2$ or Ar.

12. The manufacturing method for a composite sintered magnetic material of claim 7, wherein the pressure is 0.5 tonne/$cm^2$ to 15 tonne/$cm^2$.

* * * * *

UNITED STATES PATENT AND TRADEMARK OFFICE

CERTIFICATE OF CORRECTION

PATENT NO. : 7,422,697 B2
APPLICATION NO. : 10/955883
DATED : September 9, 2008
INVENTOR(S) : Takeshi Takahashi et al.

It is certified that error appears in the above-identified patent and that said Letters Patent is hereby corrected as shown below:

On the Cover Page, item [56], References Cited, FOREIGN PATENT DOCUMENTS: Delete duplicate references "GB 805710 10/1958" and "WO 01/45116 11/2001"

Signed and Sealed this

Sixth Day of January, 2009

JON W. DUDAS
*Director of the United States Patent and Trademark Office*